US006983715B2

(12) United States Patent
Boudeau et al.

(10) Patent No.: US 6,983,715 B2
(45) Date of Patent: Jan. 10, 2006

(54) INFLATABLE BOAT HAVING A DETACHABLE RIGID HULL

(75) Inventors: Lionel Boudeau, Roses (ES); Emmanuel Pommier, Figueres (ES)

(73) Assignee: Zodiac International, Issy les Moulineaux (FR)

( * ) Notice: Subject to any disclaimer, the term of this patent is extended or adjusted under 35 U.S.C. 154(b) by 29 days.

(21) Appl. No.: 10/839,493

(22) Filed: May 5, 2004

(65) Prior Publication Data

US 2004/0244669 A1 Dec. 9, 2004

(30) Foreign Application Priority Data

May 7, 2003 (FR) ..... 03 05554

(51) Int. Cl.
*B63B 7/04* (2006.01)

(52) U.S. Cl. ..... 114/352; 114/345

(58) Field of Classification Search ..... 114/345, 114/352, 353, 354

See application file for complete search history.

(56) References Cited

U.S. PATENT DOCUMENTS 842,349 A * 1/1907 Skene ..... 114/352
3,822,427 A * 7/1974 Ewart, Jr. ..... 114/352
3,883,909 A 5/1975 Fisher et al.
4,052,761 A * 10/1977 Rilling ..... 114/352
4,366,769 A * 1/1983 Lingeman ..... 114/352
5,943,978 A 8/1999 Garanier

FOREIGN PATENT DOCUMENTS

| | | |
|---|---|---|
| DE | 20107120 | 1/2002 |
| EP | 0875447 | 11/1998 |
| FR | 1525790 | 5/1968 |
| FR | 2765855 | 1/1999 |
| GB | 2277492 | 11/1994 |
| WO | WO 02/092421 | 11/2002 |

* cited by examiner

*Primary Examiner*—Andrew D. Wright
(74) *Attorney, Agent, or Firm*—Dean W. Russell; Kilpatrick Stockton LLP

(57) ABSTRACT

An inflatable boat with a V-shaped hull comprising at least a central longitudinal strip that is rigid, and that is made up of a plurality of longitudinal segments assembled together end-to-end, and secured together by releasable fixing means which comprise: at each side top end, at least one longitudinally-extending projecting finger on an end of one segment and at least one respective facing longitudinal recess provided in the abutting end of the adjacent segment; and, in the tip portion of the V-shape and inside the hull, at least one connection member on an end of one segment, and at least one corresponding connection member situated inside the adjacent segment, and a retaining pin suitable for being engaged through the mutually aligned perforations in the two connection members.

12 Claims, 4 Drawing Sheets

Prior Art

INFLATABLE BOAT HAVING A DETACHABLE RIGID HULL

CROSS-REFERENCE TO RELATED APPLICATION

This application claims priority to French Patent Application No. 03 05554 filed on May 7, 2003, the entire contents of which are hereby incorporated by reference.

FIELD OF THE INVENTION

The present invention relates generally to the field of inflatable boats having rigid hulls, and it relates more specifically to improvements made to those of such rigid-hulled inflatable boats in which the hull is made up of a plurality of segments facilitating stowage and transport of such boats.

BACKGROUND OF THE INVENTION

Document FR-A-2 765 855 describes an inflatable boat of the type in question and which comprises:

two side buoyancy tubes;

a floor that is rigid at least transversely and that is interposed between said tubes:

a flexible bottom sheet that covers the underside of the rigid floor and that is secured in watertight manner to said tubes; and a hull of approximately V-shaped cross-section disposed under the flexible bottom sheet, which hull comprises at least a central longitudinal strip in the shape of a V-shaped trough that is rigid, and that is made up of a plurality of longitudinal segments assembled together end-to-end, and secured together by releasable fixing means.

With reference firstly to FIGS. 1 and 2 of the accompanying drawings (which are reproductions respectively of FIGS. 4 and 9 of Document FR 2 765 855), it is recalled briefly that the inflatable boat, given overall numerical reference 1, has respective floats in the form of inflatable tubes 2 on each of its sides. The two tubes can be joined at the bow to give an overall U-shape that is open at the stern of the boat. The two buoyancy tubes 2 are interconnected at the stern by a transom (not shown in FIGS. 1 and 2) and at their bottoms via a floor 3 that is rigid, at least transversely.

A flexible bottom sheet 16 extends under the rigid floor 3 and covers the underside of the rigid floor 3, being secured in watertight manner to the two buoyancy tubes 2 and to the aft end of the rigid floor or to the transom.

Under the flexible bottom sheet 16, a hull 4 is situated that is approximately V-shaped in cross-section. The hull 4 comprises at least a central longitudinal strip 6 in the form of a V-shaped trough which is rigid and which is made up of a plurality of longitudinal segments assembled together end-to-end, and secured together by releasable fixing means.

In the example shown in FIG. 1, the rigid strip 6 occupies only the central portion of the hull 4, and the two portions of the hull that are situated on either side of the rigid strip 6 are made up of flexible strips 7 made of a material of the same type as the material of the flexible bottom sheet 16. Releasable fixing means 8 (e.g. and advantageously a rod engaged in a groove) secure the flexible strips 7 detachably to the rigid central strip 6, while, via their outermost longitudinal edges, the flexible strips 7 are secured at 13 to the flexible bottom sheet 16, as shown in FIG. 1 (or even to the buoyancy tubes 2 in the examples of FIGS. 1 to 3 in Document FR 2 765 855).

In the specific example shown in FIG. 1, the rigid floor 3 has a particular make-up since it is made up of a plurality of panels 9 (e.g. from two panels to four panels depending on the length of the boat, and typically three panels for a medium-sized boat) which are rigid (e.g. made of metal, in particular of aluminum or of aluminum alloy). In addition, each floor panel 9 has edges raised at an angle such that said edges lie approximately in alignment with the sides of the underlying hull.

In the configuration shown in FIG. 1, the flexible strips 7 are secured to the flexible bottom sheet 16 approximately along the folds 13 of the raised edges of the floor panels 9. In other words, the flexible bottom sheet 16 is provided on its bottom face with longitudinal flaps 7 that can be secured to the rigid central strip 6.

In order to hold the resulting assembly under tension, a spacer 5, advantageously of the pneumatically inflatable type, is interposed between the assembly comprising the rigid floor 3 and the flexible, bottom sheet 16, and the rigid central strip 6, as shown in FIG. 1.

In another example shown in FIG. 2, the hull 4 is constituted entirely and only by the central rigid strip 6 which is removably secured directly to the flexible bottom sheet 16 by means 8 as mentioned above, approximately along the folds 13 of the raised edges of the floor panels 9. A boat configured in this way is simpler to manufacture (flexible flaps 9 omitted) and easier to assemble (the fixing rod, which is, in this example, secured to or integral with the flexible bottom sheet 16, is tensioned better and is easier to engage into the groove provided in the edge of the central strip 6).

Document FR 2 765 855 gives the overall provisions for such boats, but it does not give any specific technical solution as regards assembly and structure of the component segments of the rigid central strip 6 of the hull 4. However, the rigidity of the hull, and therefore the rigidity of the central strip 6, which constitutes the working portion of said hull, is essential for guaranteeing that the boat has the required qualities (stability, and course-holding).

In addition, it should be emphasized that the whole purpose of boats of this type is to be capable of being assembled and disassembled as easily as possible, or even, for certain users, of being assembled and disassembled as quickly as possible and in difficult conditions (e.g. in the dark).

OBJECTS AND SUMMARY OF THE INVENTION

An object of the invention is thus to provide an original technical solution for assembling together the rigid segments of the hull, which solution is capable of satisfying the very demanding requirements of certain users.

To these ends, when an inflatable boat as mentioned in the preamble is organized in accordance with the invention, said releasable fixing means for releasably fixing together two consecutive hull segments comprise:

at each side top end, at least one longitudinally-extending projecting finger on an end of one segment and at least one respective facing longitudinal recess provided in the abutting end of the adjacent segment and suitable for receiving said projecting finger; and in the tip portion of the V-shape and inside the hull, at least one connection member on an end of one segment, and at least one corresponding connection member situated inside the adjacent segment, and a retaining pin suitable for being engaged through the connection members.

Thus, by the means provided in accordance with the invention, the two fingers provided at the top and engaged in facing recesses in adjacent segments perform both a guide function for ensuring that the two rigid segments of the hull are mutually positioned correctly while they are being assembled together, and a retaining function for mutually retaining the two segments once they are assembled together end-to-end.

In order to prevent the two segments as assembled together in this way from coming apart, it is then much simpler, rather than providing locking at said fingers engaged in the recesses, to implement locking means in the tip of the V-shape, both for preventing the two segments from coming apart in their bottom zone and because sufficient space is available there to locate means of very simple design (a pin engaged through connection members).

It should be noted that the means implemented for reliably assembling together two rigid hull segments are extremely simple, are inexpensive because of their structural simplicity, and, above all, do not require any tools for being implemented. Finally, this simplicity makes it possible for assembly to be performed under difficult conditions.

In order to facilitate inserting and removing the pin for securing together and releasing the retaining connection members, it is advantageous for one of the segments to be provided with an opening near the connection member, which opening is provided with a hatch that can be opened and closed from the outside. Here too, the presence of the hatch considerably simplifies and thus accelerates inserting and removing the pin.

Advantageously, at least when the structure of the boat so permits, it is desirable for a substantially triangular respective transverse plate to be provided at each end of each of the intermediate and stern segments, and at the aft end of the bow segment. These plates make it possible to strengthen the rigid hull segments. In order to avoid an undesirable increase in weight, it is possible for each plate to be perforated.

In order for the hull to have the desired rigidity while the boat is being used, it is possible for the hull segments to be made of a lightweight metal such as aluminum or an aluminum alloy so as to be as light in weight as possible, thereby facilitating transporting the boat as disassembled and folded up. It is also possible to consider making the hull segments of a composite material that has suitable weight and strength characteristics.

Also with a view to obtaining a hull structure that is as rigid as possible when in use, and also to assembling reliably the rigid segments to the flexible bottom sheet or to the flaps secured thereto, provision is made for each longitudinal edge of each hull segment to be provided with two mutually-parallel grooves suitable for receiving a pair of rods or of fixing bolt ropes secured to or integral with said flexible bottom sheet.

A preferred embodiment of the invention, which is applicable to the boat shown in FIG. 2 of the accompanying drawings, consists in that the rigid floor is made up of a plurality of segments assembled together end-to-end in detachable manner, each floor segment having side edges that are raised so that the floor segment has a cross-section which is approximately V-shaped with a truncated tip, and in which the inclination of the branches is approximately the same as the inclination of the branches of the V-shape formed by each hull segment;

in that the flexible bottom sheet fits snugly over the rigid floor, with its pairs of bolt ropes extending substantially along the two longitudinal folds formed by the raised edges of the rigid floor; and in that the rigid hull mounted on said pairs of bolt ropes extends, downwards, approximately in alignment with the raised edges of the rigid floor.

In order to improve the securing of the rigid segments to the flexible bottom sheet or to the flaps secured thereto, it is advantageously possible to make provision for the flexible bottom sheet to be provided, at its forward end, with a flap suitable for being folded and strapped over the forward end of the bow segment of the rigid hull, and for retaining means, in particular having straps, to be provided at the aft end of the stern segment, for locking the rigid hull longitudinally.

In the most common embodiments, the central rigid strip of the hull may advantageously be constituted by two to four segments, typically three segments for a medium-sized boat, it being possible for this number of rigid hull segments to match the number of rigid floor segments in the embodiment of the boat shown in FIG. 2.

BRIEF DESCRIPTION OF THE DRAWINGS

The invention will be better understood on reading the following detailed description of certain particular embodiments which are given merely by way of non-limiting example. In the description, reference is made to the drawings, in which.

DETAILED DESCRIPTION OF THE INVENTION

Figure 1:
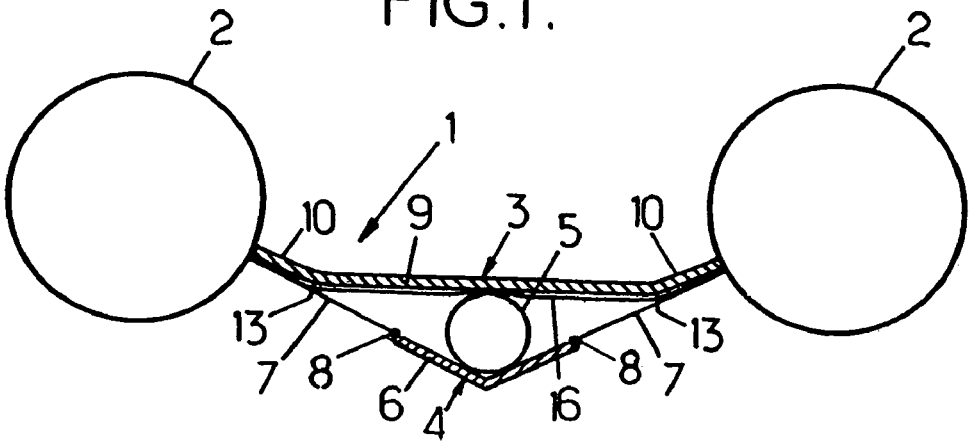
FIGS. 1 and 2 are diagrammatic cross-section views of two examples of inflatable boats to which the invention applies.
Figure 2:
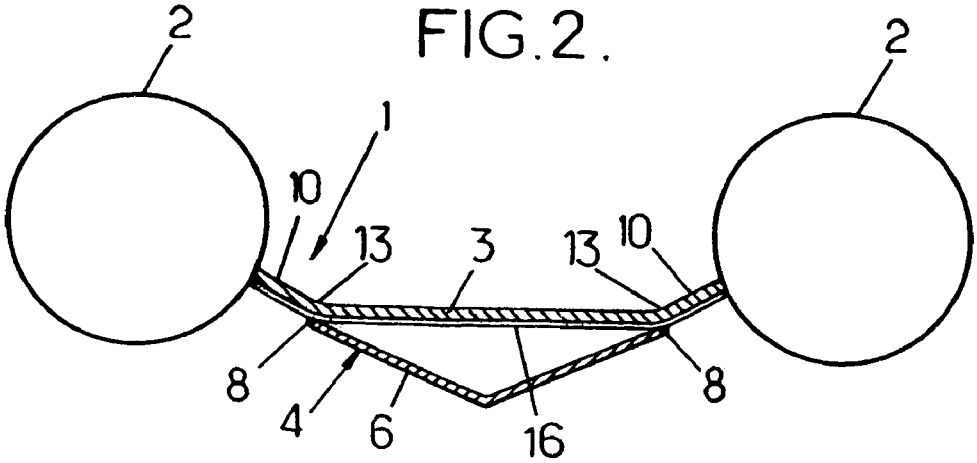
Prior Art FIG.2.
Figure 3:
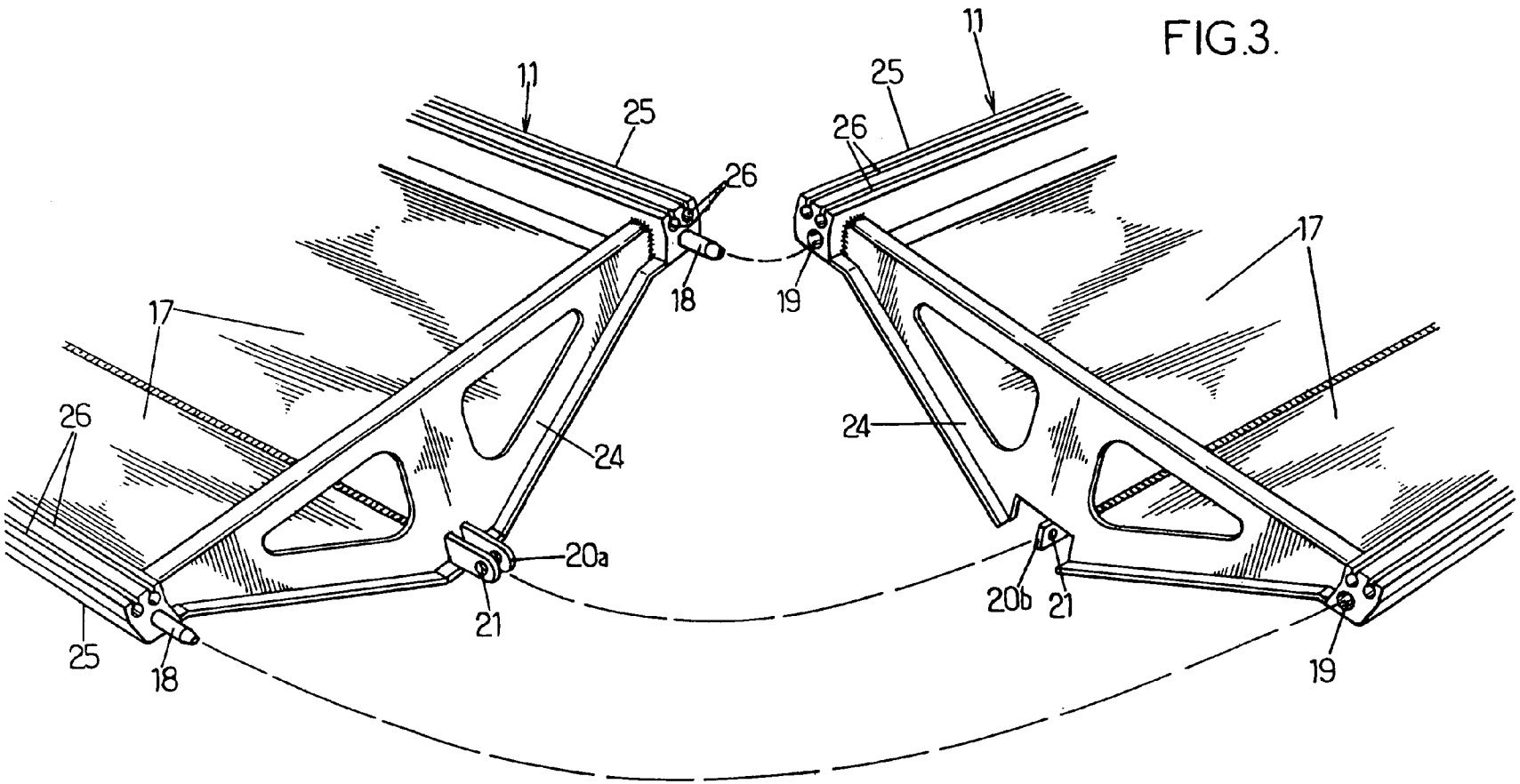
FIG. 3 is a fragmentary perspective view showing how the ends of two mutually adjacent hull segments are shaped with a view to them being assembled together in accordance with the invention.
Figure 4:
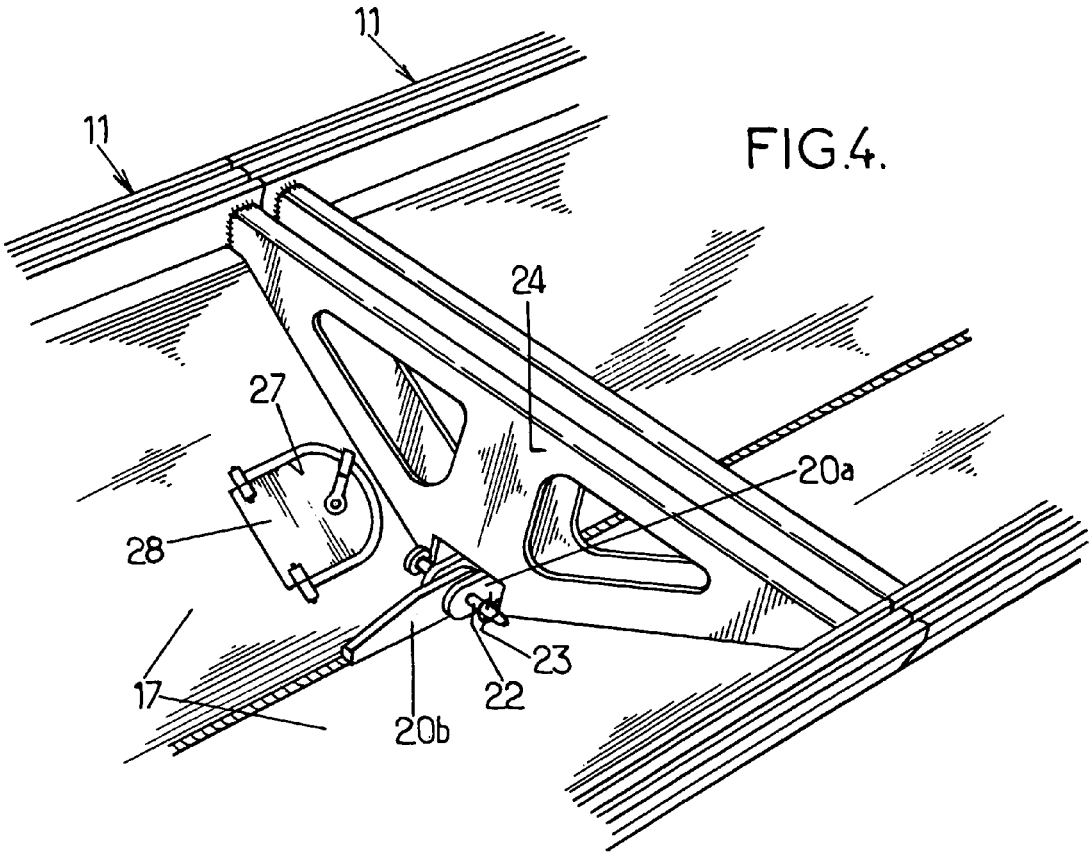
FIG. 4 is a fragmentary perspective view showing the two ends of the mutually adjacent hull segments of FIG. 3 after they have been assembled together.
Figure 5:
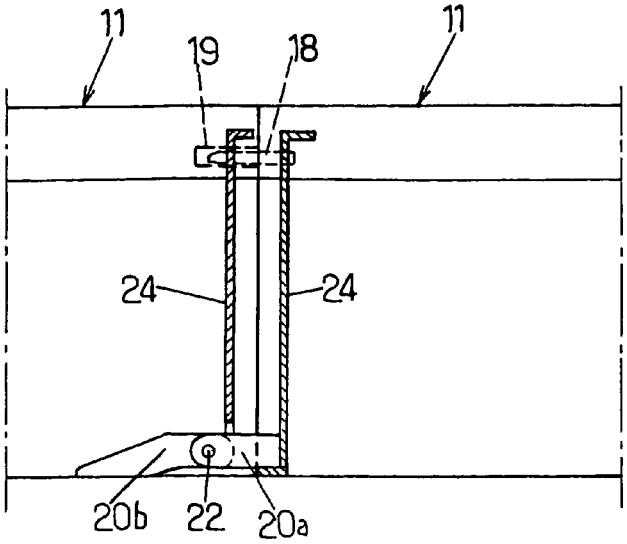
FIG. 5 is a highly simplified longitudinal vertical section view of the configuration of FIG. 4.

The following description, given with reference to FIGS. 3 to 5, refers more specifically to equipment for a boat having the structure shown in FIG. 2, this embodiment currently appearing to satisfy as well as possible the requirements of practical use. However, it is understood that the provisions explained above are entirely transposable, ignoring the dimensions and in particular ignoring the width of the rigid hull segments, to the embodiment of the boat of FIG. 1.

With reference firstly to FIG. 3, the ends of two rigid hull segments 11 suitable for being assembled together end-to-end are shown in perspective.

Each rigid segment 11 is made of a metal, and preferably of a lightweight metal (e.g. aluminum or aluminum alloy) or of a composite material, and it is formed of two walls 17 disposed in a V-shaped configuration so that the cross-section is V-shaped, as explained above.

At each side top end of the ends of one of the segments 11 (the left segment in FIG. 3), at least one projecting finger 18 is provided that extends longitudinally, and, at least one respective longitudinal recess 19 is provided in register in the other segment 11 (the right segment in FIG. 3).

Naturally, it is possible for the fingers 18 and the recesses 19 to be located in any configuration, i.e. both fingers 18 can be situated on the same segment 11 and both recesses 19 can be situated on the other segment 11, or else each segment end 11 can be provided with a finger 18 on one side and with a recess 19 on the other.

The fingers 18 may be of sufficient dimensions, e.g. of sufficient length to penetrate deeply into the respective recesses 19, and to withstand the shear forces.

This finger/recess configuration is not only suitable for mutually supporting the two abutting ends of the adjacent segments, but also for facilitating assembly of the two segments by procuring guiding which ensures that the two segments are mutually aligned.

In order to lock the assembling-together of the two ends of the segments 11, it is admittedly possible to act on the fingers 18, e.g. with snap-fastening means. However, such means are complex and fragile and they do not procure the desired strength and reliability.

Locking means are therefore provided at the tip of the V-shape and inside the rigid segments 11, in the form of two perforated connection members. One of the connection members 20*a* (on the left segment 11 of FIG. 3) projects longitudinally from the end of the segment 11, and the other connection member 20*b* is situated inside the other segment 11. In the position in which the two segments 11 are assembled together, the two connection members 20*a*, 20*b* are side by side, with their respective holes 21 in mutual alignment. A retaining pin 22 is engaged through the holes 21 as shown in FIG. 4, and it prevents the two segments 11 from moving apart.

Advantageously, one of the connection members (e.g. the projecting connection member 20*a* in FIG. 3) is constituted in the form of a fork made up of two connection members flanking the opposite connection member 20*a*. Assembly is thus obtained that is more stable and the pin 22 is fixed more securely.

In order to prevent the pin 22 from coming out in unwanted manner (e.g. when subjected to impacts or vibration), it is possible to add a safety cotter pin to said pin as shown at 23 in FIG. 4.

In order to facilitate access to the locking members 22, 23 from the outside, an opening 27 is provided, with a hatch 28 that can be opened and closed from the outside, in one of the walls 17 of the segment 11 that is equipped with the inside connection member 20*b*, said opening being situated approximately facing the connection member 20*b*, as shown in FIG. 4.

FIG. 5 is a diagrammatic axial section view through the boat, showing the two hull segments 11 in the assembly position.

In order to increase the rigidity of the hull and in order to optimize the performance of the boat in terms of stability and of course-holding, provision is made for each end of each of the stern and intermediate segments 11 and the end of the bow segment to be reinforced with a transverse plate (or floor stiffener plate) 24 that is substantially triangular in shape, and that may advantageously be constituted in the form of a perforated plate as shown in FIGS. 3 to 5, or that may be constituted by a truss.

As indicated above, the rigid hull segments 11 are assembled to the flexible bottom sheet 16 (embodiment shown in FIG. 2) or to the flexible side flaps 7 (embodiment of FIG. 1) by engaging a longitudinal rod (or bolt rope) carried by the flexible bottom sheet 16 or by the flap 7 into a longitudinal groove in the corresponding longitudinal edge of the segment 11. In order to improve the strength of the coupling between each segment 11 and the flexible bottom sheet 16 or each flap 7, provision is made to duplicate the means implemented, with, for each side, two parallel side-by side rods (or bolt ropes) engaged in respective ones of two parallel groves. Thus, as shown in FIGS. 3 and 4, the longitudinal edge of each of the walls 17 of each segment 11 is organized in the form of a shaped-section member provided with two parallel grooves 26.

Figure 6:
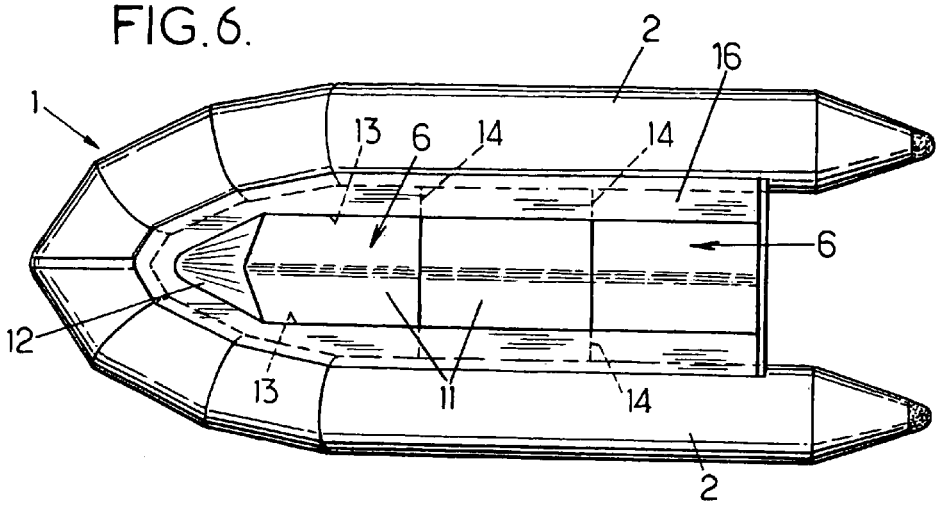
FIG. 6 is a view from underneath of an inflatable boat of the type shown in FIG. 2, configured in accordance with the invention.
Figure 7:
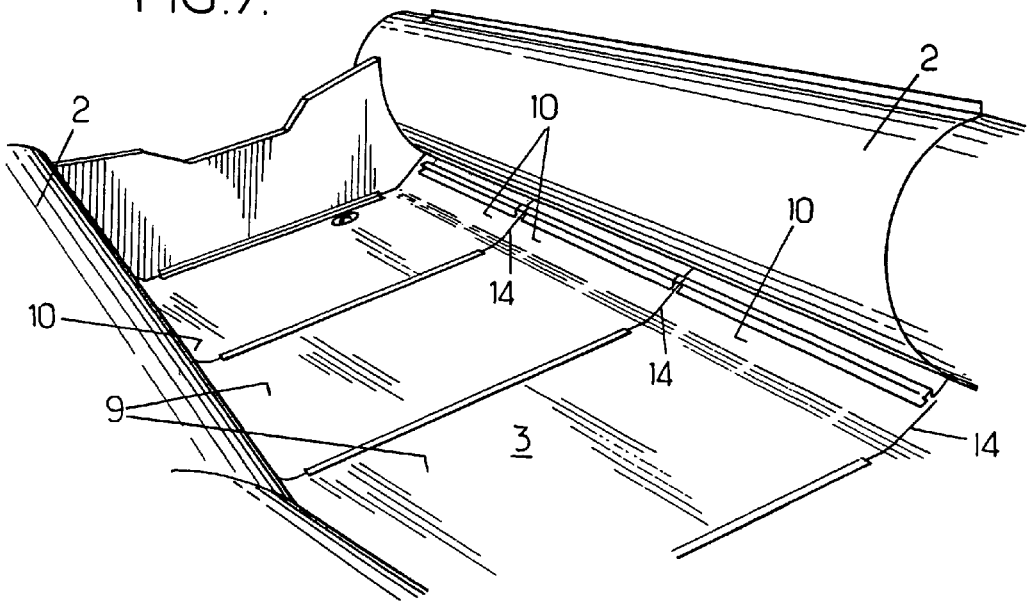
FIG. 7 is a perspective view looking towards the stern, showing the inside of the boat of FIG. 6.

As indicated above, the above-described provisions can be applied particularly advantageously to boats of the FIG. 2 type. FIGS. 6 and 7 are shown respectively in a view from underneath, and in a fragmentary perspective view of the inside of a boat organized in this way.

In FIG. 6, it is easy to recognize the rigid central strip 6 made up, in this example, of three end-to-end segments 11.

In order to improve the profile of the bow of the hull, a triangular flap or gusset 12 made of canvas and secured to the flexible bottom sheet 16 covers the forward end of the first segment 11 over which it is strapped. In addition, the gusset 12 serves to constitute locking means for preventing the segments from moving forwards. Furthermore, retaining means, in particular having straps (which are not visible in FIG. 6 since they are hidden by the stern segment 11), are provided at the aft end of the stern segment 11 so as to lock it longitudinally.

Also in FIG. 6, the flexible bottom sheet 16, which is applied against the panels 9 of the floor 3, fits snugly over all of the significant pieces in relief of said floor 3, and the imprints of the end-to-end edges 14 of the floor panels 9 show through it.

In view of the specific provisions explained above, a boat organized in accordance with the invention, and in particular the boat shown in FIGS. 6 and 7, can be disassembled easily, quickly, and without any special tools being necessary. In addition, the structural means implemented are simple and inexpensive to manufacture.

The hull constituted in accordance with the invention can comprise a number of rigid segments 11 that must not be too small so that each segment is not excessively long, or too large so that the assembly/disassembly time is not excessive. A number of segments 11 lying in the range two to four would seem to be suitable in general, and three segments would appear to be acceptable for a medium-sized boat. The number of hull segments 11 can be the same as the number of floor panels 9.

What is claimed is:

1. An inflatable boat comprising:

two side buoyancy tubes;

a floor having an underside that is rigid at least transversely and that is interposed between said tubes;

a flexible bottom sheet that covers the underside of the rigid floor and that is secured in watertight manner to said tubes; and a hull of approximately V-shaped cross-section disposed under the flexible bottom sheet, which hull comprises at least a central longitudinal strip in the shape of a V-shaped trough that is rigid, and that is made up of a plurality of longitudinal segments assembled together end-to-end, and secured together by releasable fixing means, each segment having abutting ends, top ends, and a tip portion defining the V-shape;

wherein said releasable fixing means for releasably fixing together two consecutive hull segments comprise:

at each side top end, at least one longitudinally-extending projecting finger on an abutting end of one segment and at least one respective facing longitudinal recess provided in an abutting end of an adjacent segment and suitable for receiving said projecting finger; and in the tip portion of the V-shape and inside the hull, at least one connection member on an end of one segment, and at least one corresponding connection member situated inside the adjacent segment, and a retaining pin suitable for being engaged through the connection members.

2. A boat according to claim 1, wherein one of the segments is provided with an opening near the connection member of that segment, which opening is provided with a hatch that can be operated from the outside.

3. A boat according to claim 1, comprising one or more intermediate segments, a stern segment and a bow segment having an aft, wherein a substantially triangular respective transverse plate is provided at each end of each of the intermediate and stern segments, and at the aft end of the bow segment.

4. A boat according to claim 3, wherein each plate is perforated.

5. A boat according to claim 1, wherein each hull segment is made of metal.

6. A boat according to claim 5, wherein each hull segment is made of aluminum alloy.

7. A boat according to claim 1, wherein each hull segment is made of a composite material.

8. A boat according to claim 1, wherein each top end of each hull segment is provided with two mutually-parallel grooves suitable for receiving a pair of fixing bolt ropes secured to or integral with said flexible bottom sheet.

9. A boat according to claim 1, wherein the rigid floor is made up of a plurality of segments assembled together end-to-end in detachable manner, each floor segment having side edges that are raised so that the floor segment has a cross-section which is approximately V-shaped with a truncated tip, and in which the inclination of the raised side edges is approximately the same as the inclination of the V-shape formed by each hull segment;

wherein the flexible bottom sheet fits snugly over the rigid floor, the flexible sheet having pairs of bolt ropes extending substantially along the V-shape formed by the raised side edges of the floor segments;

and wherein the rigid hull is mounted on said pairs of bolt ropes and extends, downwardly, approximately in alignment with the raised side edges of the rigid floor.

10. A boat according to claim 1, wherein the rigid hull comprises a bow segment with a forward end and a stern segment with an aft end, wherein the flexible bottom sheet has a forward end with a flap suitable for being folded and strapped over the forward end of the bow segment of the rigid hull, and wherein retaining means are provided at the aft end of the stern segment, for locking the rigid hull longitudinally.

11. A boat according to claim 10, wherein the retaining means have straps.

12. A boat according to claim 1, wherein the central rigid strip of the hull is constituted by two to four segments.

* * * * *